US006101745A

United States Patent [19]

Grandin et al.

[11] Patent Number: 6,101,745

[45] Date of Patent: Aug. 15, 2000

[54] LOCKING DEVICES FOR SPORTS FOOTWEAR, IN PARTICULAR FOR SKI-BOOTS

[75] Inventors: Giorgio Grandin, Trevignano; Giuliano Piva, Giavera del Montello; Daniele Vanin, Quinto di Treviso, all of Italy

[73] Assignee: Tecnica SpA, Treviso, Italy

[21] Appl. No.: 09/185,497

[22] Filed: Nov. 4, 1998

[30] Foreign Application Priority Data

Nov. 5, 1997 [IT] Italy ..... TV97A0153

[51] Int. Cl.[7] ..... A43B 5/00

[52] U.S. Cl. ..... 36/118.7; 36/118.2

[58] Field of Search ..... 36/118.1, 118.2, 36/118.7, 118.8

[56] References Cited

U.S. PATENT DOCUMENTS

| | | | |
|---|---|---|---|
| 4,800,658 | 1/1989 | Zanatta | 36/118.8 |
| 4,899,469 | 2/1990 | Hilgarth | 36/118.8 |
| 5,276,982 | 1/1994 | Wittmann | 36/118.8 |
| 5,457,899 | 10/1995 | Chemello . | |

FOREIGN PATENT DOCUMENTS

| | | | |
|---|---|---|---|
| 85026 | 8/1983 | European Pat. Off. | 36/118.7 |
| 248149 | 12/1987 | European Pat. Off. | 36/118.8 |

*Primary Examiner*—M. D. Patterson

*Attorney, Agent, or Firm*—Griffin, Butlaer, Whisenhunt & Szipl, LLP

[57] ABSTRACT

Locking device for sports footwear such as ski boots, in which a lower leg envelopment (12) is hinged to a shell (10). The device consists of a support (20) fixed on an inner wall of the lower leg envelopment, in which there is mounted a cam (24) on which acts a rocker arm (35) that constitutes the relative complementary surface for the cam. The coupling of the cam to the rocker arm determines the skiing or walking attitude of the footwear, in relation to the rotations of the cam which are controlled by a lever (32) arranged beside it. This device is particularly compact and structurally strong. It can be produced in plastics material, and can be fitted directly to already assembled footwear, without requiring other operations for its utilization.

13 Claims, 5 Drawing Sheets

LOCKING DEVICES FOR SPORTS FOOTWEAR, IN PARTICULAR FOR SKI-BOOTS

The invention concerns an improvement to the locking devices for sports footwear, especially ski boots.

More specifically, said device is intended for those items of footwear which comprise an outer shell which extends from the sole and a lower leg envelopment located above the shell, to which it is hinged by means of pins or the like along an axis transverse to the footwear.

The lower leg envelopment can rotate with respect to said axis between a forward position, such as, for example, that assumed by a boot in the skiing attitude, and a set-back position which makes walking easier for the person wearing the footwear: in order to maintain the lower leg envelopment in a stable manner in the forward position or to allow it to rotate backwards, in this type of footwear it is known to use the locking devices for the improvement of which the present invention is intended. These devices are fitted subsequently to the footwear and operate between the lower leg envelopment and the shell.

They consist essentially of articulated systems formed of small connecting-rods, cranks, cams or the like, of different configurations and connected to one another in accordance with the different technical solutions developed by the footwear manufacturers; in order to effect the locking of the lower leg envelopment in the forward position or to allow its rotation into the set-back position, there is generally provided as the control element of the articulated systems a lever on which a person can act in a fairly simple manner.

These levers in fact rotate in a vertical plane with respect to the footwear (that is, perpendicular to the sole) and in order to lock the lower leg envelopment in the forward position they are customarily rotated upwards, until they are juxtaposed with the lower leg envelopment so as not to project with respect to the latter: that is, in order to prevent the lever from hindering the movements of the skier. An important feature concerning this type of locking device consists in maintaining the lever stable in the state juxtaposed with the lower leg envelopment just mentioned.

It is clear, in fact, that if this requirement were not fulfilled, during skiing there would be the risk that the lower leg envelopment might rotate backwards, causing the boot to lose the skiing attitude, with the consequences which it is easy to imagine might result therefrom.

In order to prevent this situation, in the articulated systems there are generally arranged devices which, however, often result in an increase in their structural complexity.

For example, springs are widely used which, by acting on the articulated system, ensure its stability in some configurations, thus obtaining the desired result.

A ski boot with a locking device which reflects this basis is described in the published European Patent Application No. 0 248 149; from the text and the drawings of this document it is easy to ascertain that the mechanism which allows the boot to be locked in the skiing attitude is certainly not of the simplest type.

More generally, it may be stated that the springs or the other equivalent resilient elements which are used in the various locking devices implicitly represent an added-on component with respect to the articulated system, which it would be of advantage to be able to eliminate so as to simplify the device structurally.

As an alternative to those just mentioned, therefore, locking devices are also known in which their articulated systems do not have resilient elements, but they nevertheless prove excessively complicated and/or cumbersome; it is in fact easy to understand that the devices in question need to be fairly simple not only for the reasons already indicated, but also to increase their reliability and to be compact so as not to take up too much space.

An example of a device of this type is contained in another European Patent Application, No. 0 085 026.

The technical problem on which this invention is based is that of arranging a locking device for sports footwear, and in particular ski boots having a shell and a lower leg envelopment hinged to the latter, which will have structural and functional features such as to eliminate the drawbacks manifested by the state of the art described above.

In other terms, it is therefore a question of producing a locking device which satisfies the functional requirements already illustrated, while at the same time being structurally simple so as to occupy less space and also to be industrially more advantageous compared with the devices marketed at present. Said problem is solved by a locking device the features of which are disclosed in the claims annexed to this description.

The invention will be more easily understood in the light of the example described hereinafter, relating to one of its preferred and non-exclusive embodiments illustrated in the appended drawings, in which.

Figure 1:
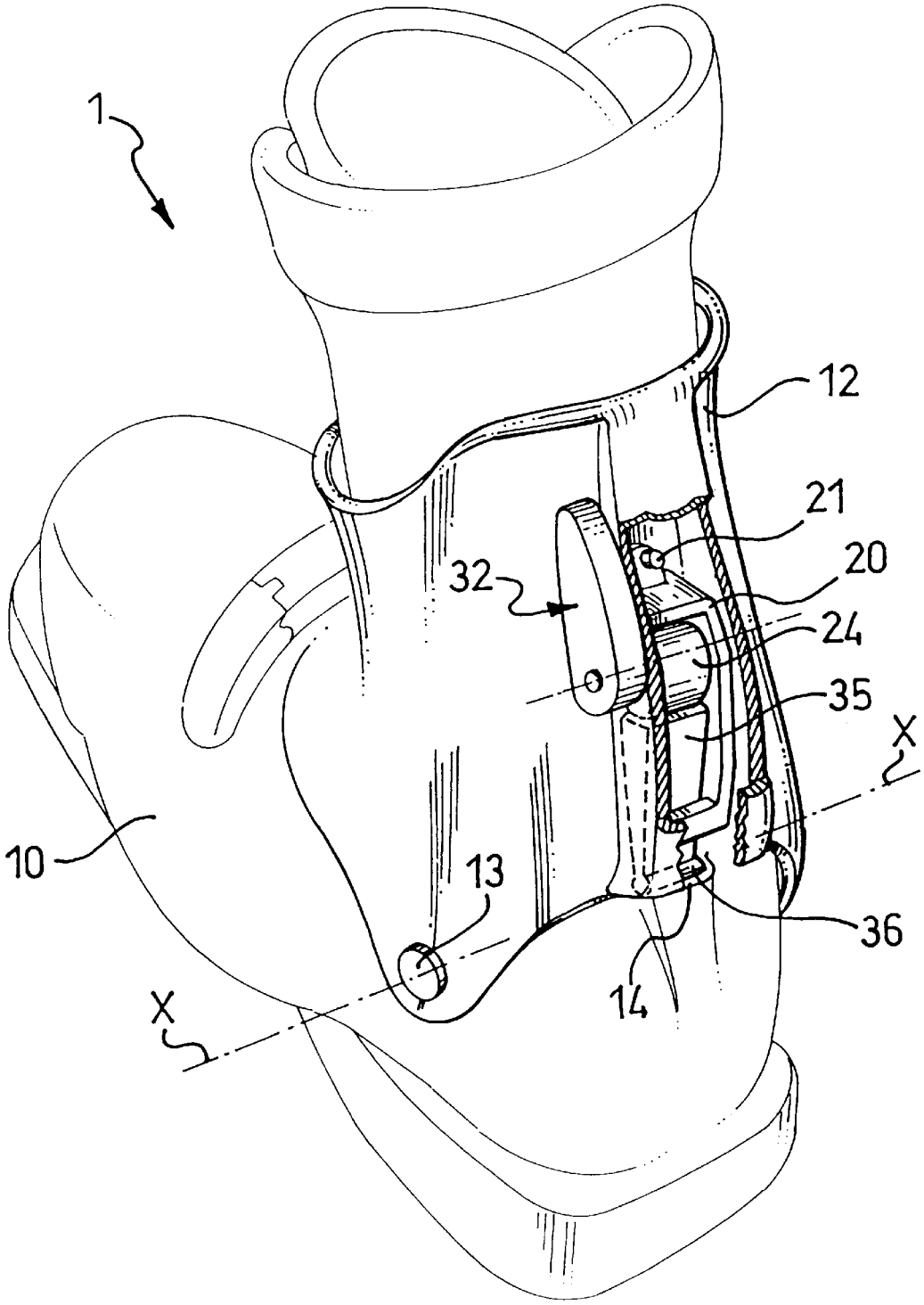
FIG. 1 is a perspective view, from the rear and partly cut away, of a boot equipped with a locking device according to the invention.

With reference to the drawings just mentioned, in these the reference 1 indicates as a whole a ski boot to which is fitted a locking device 2 produced according to the invention.

The lower part of the boot 1 consists of a shell 10 which rests on a sole 11 and above which is hinged a lower leg envelopment 12, which defines the upper part of the boot; the shell and the lower leg envelopment are produced from plastics material and enclose inside them an inner boot, not provided with a number in the drawings, and in which the foot of the skier is housed more comfortably.

The lower leg envelopment 12 is fixed to the shell in a manner which is known per se, that is to say with bosses 13 which are located in corresponding positions on opposite sides of the boot (only one of these is visible in the drawings); the said bosses define an axis X—X transverse to the boot, with respect to which the lower leg envelopment 12 can rotate between a forward position, assumed when the boot is in the skiing attitude, and a set-back position to make walking easier for the wearer of the boot.

These positions will be clarified in the continuation of this description.

In the region of the heel of the boot, on the shell 10 there is formed a seating 14 in slight relief with respect to the latter; above said seating there is a notch 15 which allows greater freedom of movement for the leg in the walking attitude of the boot.

On the rear wall of the lower leg envelopment 12, that is to say, that which is located at the notch 15 of the shell, there is fitted the locking device 2 of the present invention.

This device consists essentially of three elements hinged to one another by means of pins.

More precisely, the first of these elements is a support 20 which is substantially box-like in shape and is fixed to the inner wall of the lower leg envelopment 12 by means of a screw 21; the two arms 20*a,* 20*b* of the support are provided respectively with a hole 22*a,* 22*b* and with a slot 23*a,* 23*b,* the functions of which will be explained more clearly hereinafter.

The second element of the locking device is a cam 24 having a profile which comprises a curved section 25 and a flat section 26; the said cam has passing through it transversely a bore 27 at the ends of which there are two appendages 28*a,* 28*b* which project slightly from opposed sides of the cam, so as to be able to be rotatably housed in the holes 22*a,* 22*b* of the support 20 which, in this context, therefore serve as bearings.

The bore 27 is shaped internally with two opposed flat faces 29, so as to form a prismatic pair together with a pin 30 of a shape complementary thereto and fitting inside it; the pin 30 has a round head 31 at one end and has a length such that at the opposite end from the head it projects with respect to the bore 27, so that a lever 32 can be mounted on its terminal part.

More precisely, the lever 32 has an externally cylindrical base 33, corresponding to the bead 31 of the pin, and the functions of which will become clearer hereinafter.

The third element of the locking device consists of a rocker arm 35 which has an edge 36 shaped like a pin, and two appendages 37*a,* 37*b* projecting from opposed sides thereof, which are intended to engage respectively in the slots 23*a,* 23*b* of the support 20. Finally, on the opposite part from the shaped edge the rocker arm 35 has a flat surface 38 complementary to the active profile of the cam during the rotation of the latter.

From the appended drawings it can be understood how the elements which constitute the locking device are connected to one another and are fitted as a whole onto the boot.

It need only be stated, however, that the support 20 is housed in a recess 40 formed at the rear in the lower leg envelopment 12 and bounded by two flanks 41*a,* 41*b;* the latter respectively support rotatably the head 31 of the pin 30 and the cylindrical base 33 of the lever 32, thus allowing the rotation of the pin 30.

It should further be noted that since the support 20 is screwed to the inner wall of the lower leg envelopment 12, it is rigidly connected to the latter, while the rocker arm 35, having the appendages 37*a,* 37*b* slidingly engaged in the slots 23*a,* 23*b* and the shaped edge 36 housed in the seating 14 on the shell 10, can pivot with respect to the said seating.

In the light of these explanations it is possible to understand how the cam 24 is controlled by the lever 32, in order to effect the functioning of the locking device which occurs as follows.

Figure 2:
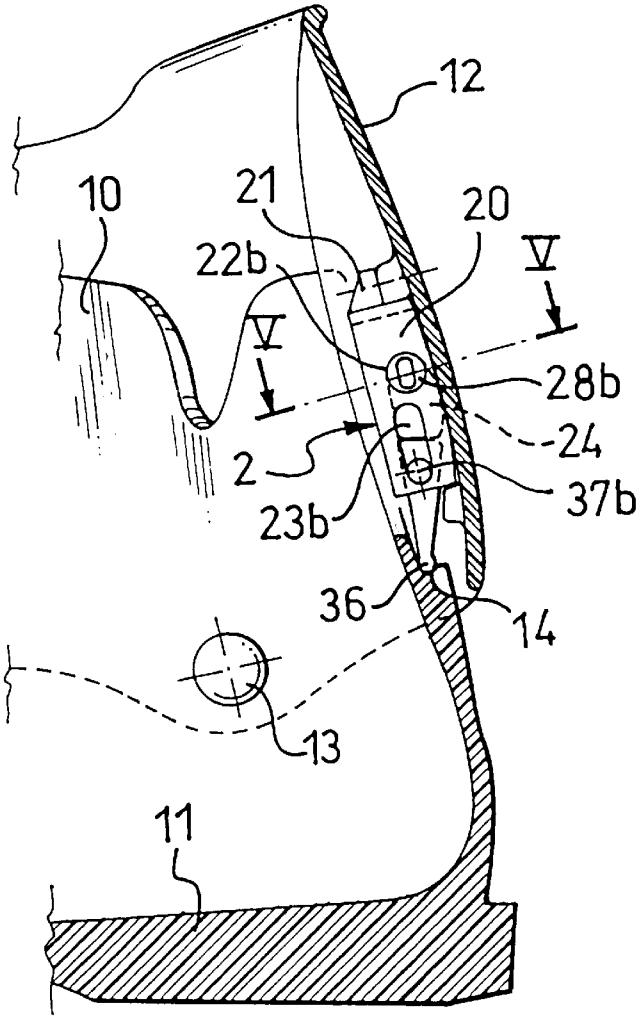
Figure 5:
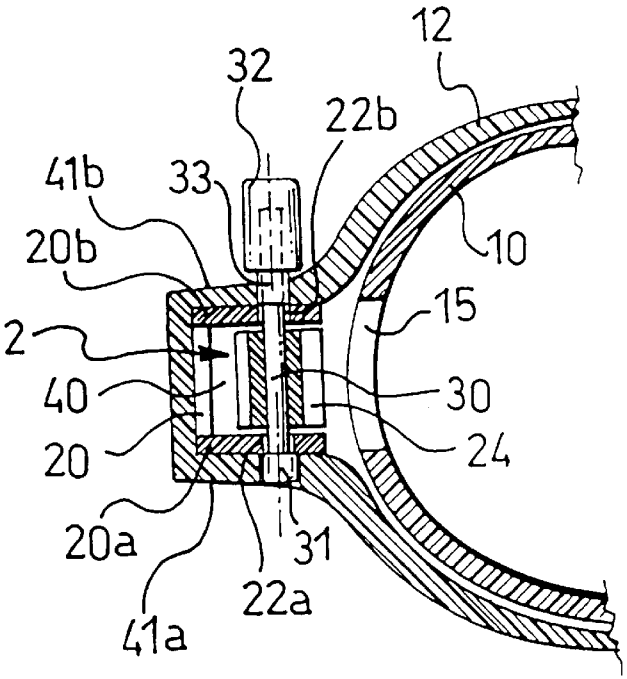
FIG. 5 is a view in section along the line V—V in FIG. 2.

Referring to the operating state in FIG. 2, in this state the boot 1 and the relative locking device 2 are in the skiing attitude, that is to say, with the lower leg envelopment 12 rotated with respect to the axis X—X defined by the bosses 13 into a forward position and with the device 2 in which the cam 24 is orientated in such a way that the flat section 26 of its profile bears against the corresponding surface 38 of the rocker arm 35. It may be observed that in this situation the aforesaid profile section and the flat surface are orientated transversely to the support 20, while the shaped edge 36, the appendages 37*a,* 37*b* and the pin 30 are aligned with one another in a straight line (see FIG. 2). In order to bring the boot into the second operating state shown in FIG. 3, that is to say, that in which it is used for walking, the lever 32 is acted upon, causing it to rotate together with the cam 24, in a clockwise direction with reference to FIG. 2.

As a result of such rotation there is a slight interference between the profile of the cam and the rocker arm because, as will be seen from the drawings, the passage from the flat section 26 to the curved section 25 of the profile of the cam comprises an increase in the distance between the point of contact of the cam (with the surface 38 of the rocker arm) and its axis of rotation: as a consequence, by slightly forcing the rotation of the lever (and therefore also of the cam) in order to overcome this interference, the cam undergoes a small upward movement (still rotating about the axis X—X together with the lower leg envelopment 12) which allows it to turn by that amount in order to bring the curved section of its profile into contact with the flat surface of the rocker arm.

Figure 3:
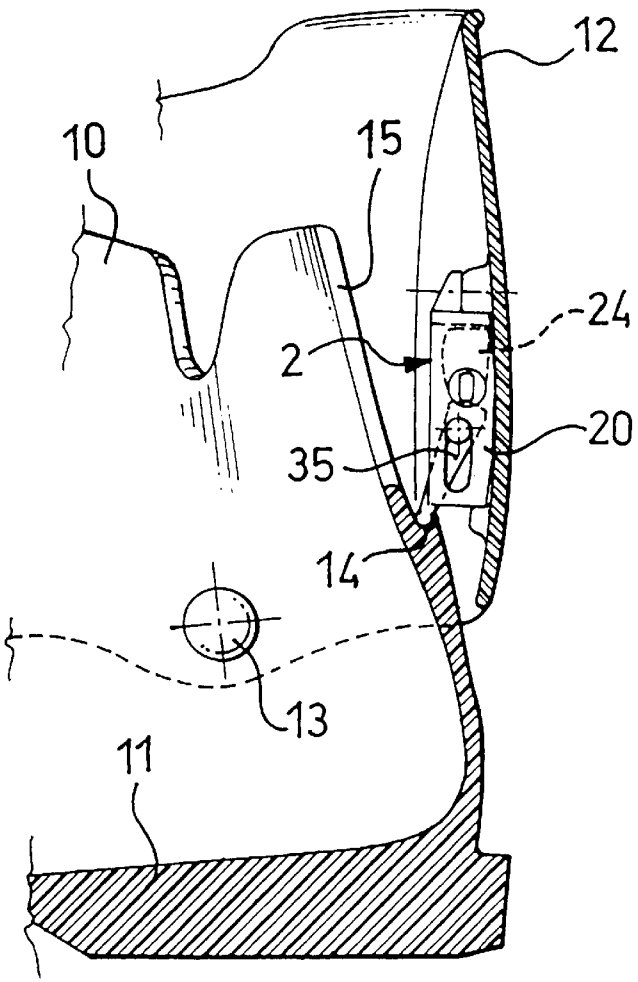
FIGS. 2 and 3 show a view in longitudinal section of the rear part of the boot in FIG. 1, in respective operating states.
Figure 4:
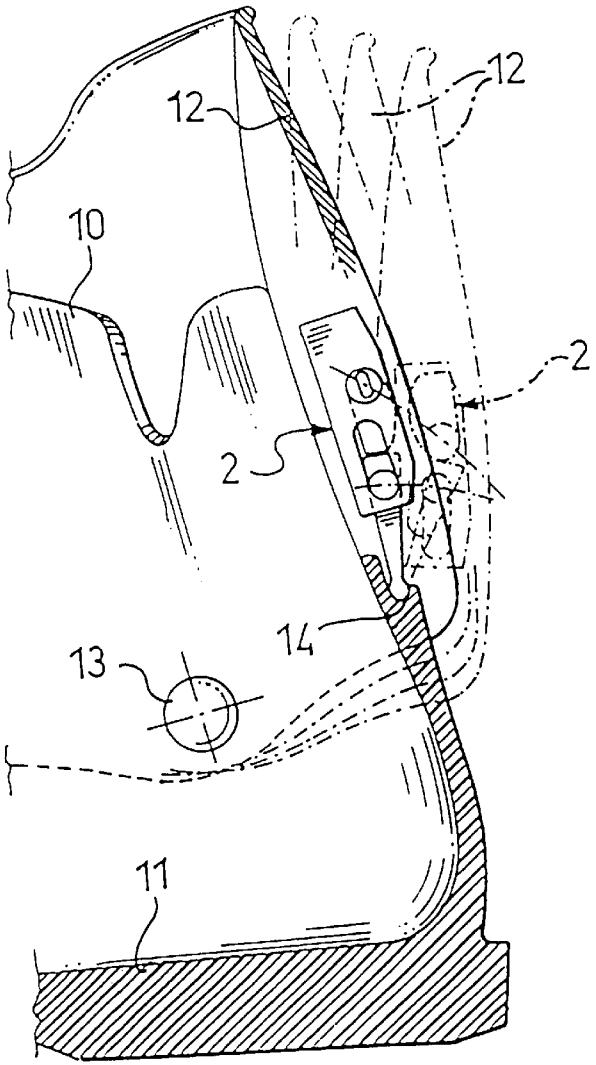
FIG. 4, is a view analogous to that in FIGS. 2 and 3, shows the movements of the various components of the boot for passing from one of the operating states to the other.
Figure 6:
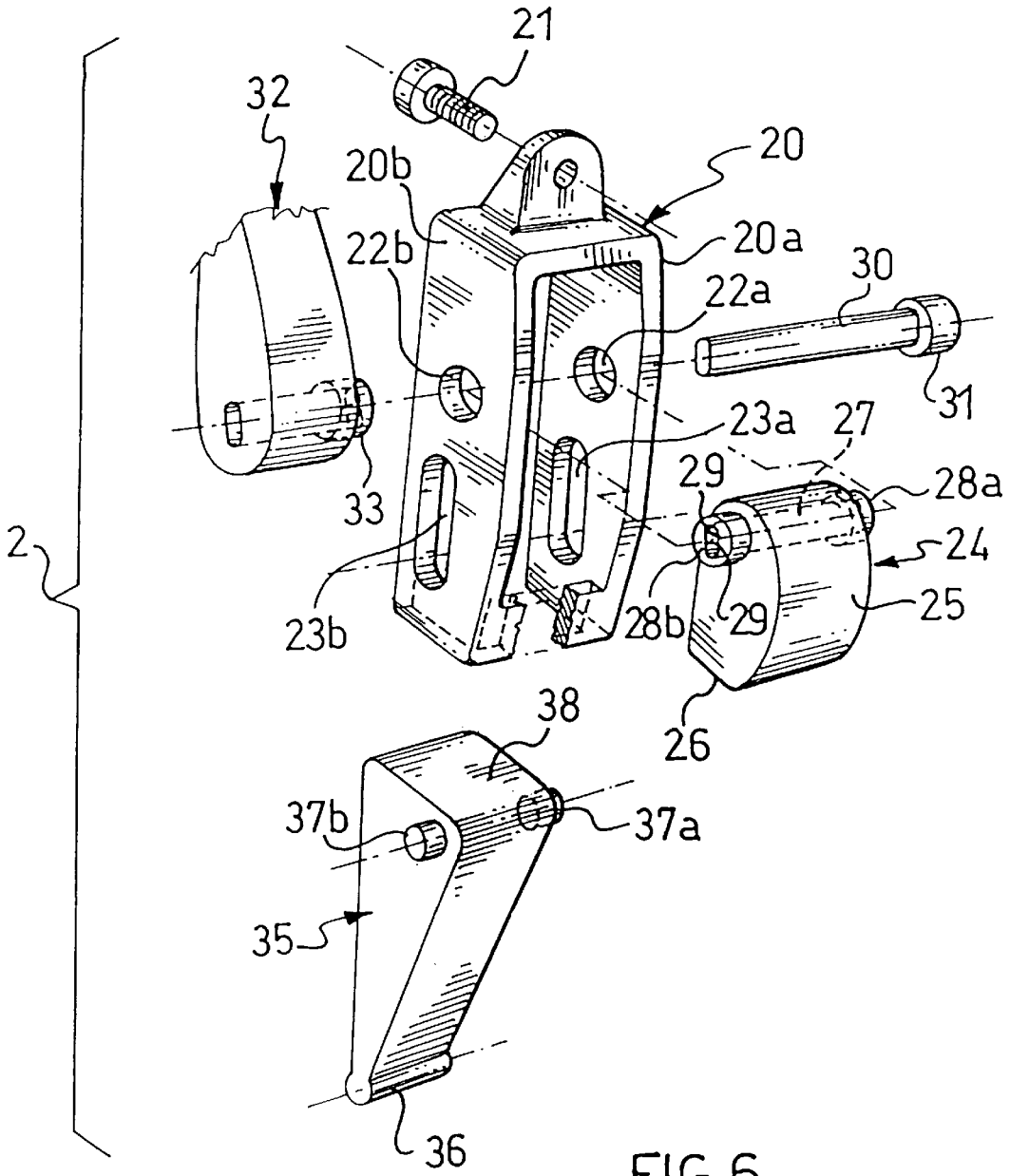
FIG. 6 is an exploded view of the locking device relative to the preceding figures.

After this, the locking device is brought into the configuration in FIG. 3, by way of a series of movements shown diagrammatically in FIG. 4.

It will be observed that while the cam 24 rotates rigidly fixed to the pin 30 and at the same time moves in translation together with the support 20, which is in turn rigidly fixed to the lower leg envelopment 12 (it would also be more precise to state that the support 20 rotates together with the lower leg envelopment 12 with respect to the axis X—X defined by the bosses 13), the rocker arm 35 pivots with the centre on its shaped edge 36 bearing on the seating 14: as a result of the various circular paths travelled by the points of the support 20 and of the rocker arm 35, the appendages 37*a,* 37*b* of the latter slide along the slots 23*a,* 23*b* of the former until they reach the position which can be seen in FIG. 3, in which the locking device 2 and the lower leg envelopment 12 lock each other.

During this phase, the curved profile 25 of the cam 24 remains in contact with the flat surface 38 of the rocker arm 35.

To bring the locking device and the boot from the walking attitude into the skiing attitude, the procedure is the reverse of that just described.

Therefore, by rotating the lever 32 and the cam 24 in an anticlockwise direction with reference to FIG. 3, the reaction exerted thereon by the rocker arm 35 causes a displacement thereof towards the left in FIG. 3, which is then transmitted to the lower leg envelopment 12 by way of the pin 30; consequently the lower leg envelopment rotates about the axis X—X, returning to the forward position for skiing.

It will be observed that in this phase, at the conclusion of the rotation of the cam, its flat section 26 is again arranged transversely to the support 20 and comes back into contact with the flat surface 38 of the rocker arm 35, so that the locking device 2 maintains the lower leg envelopment in the forward position in a stable and secure manner.

In this regard it should be stated that in the skiing state the stresses applied to the lower leg envelopment which would tend to cause it to rotate in a clockwise direction with respect to FIG. 2 (for example the stresses applied by the skier when he brings his weight backwards), do nothing other than push the cam towards the rocker arm and increase the pressure in the area of contact between them.

From the description just given of the exemplary embodiment of the invention, it is therefore possible to understand how the latter solves the problem on which it is based.

In fact, the articulated system controlled by the lever 32 consists essentially of three elements (the support 20, the cam 24 and the rocker arm 35) which are capable of maintaining the lower leg envelopment in the forward position by virtue of their structural and functional features, without the provision of additional components such as springs or the like.

Consequently, the production of the device of the invention, compared with those that are known which instead use such additional components, is simplified, with all the advantages arising therefrom.

Furthermore, it should be stated that the fitting of the device on the boot is also facilitated by the structural configuration of the invention.

It is necessary, in fact, to observe how the cam 24 and the rocker arm 35 are mounted on the support 20 but are not directly connected either to each other, or to the boot; it is in fact clear that the cam is indeed in contact with the rocker arm but is not connected to the latter, which in turn simply bears on the shell 10 in the seating 14 at the shaped edge 38, without however being anchored there in a fixed manner.

It should also be noted that the cam 24 is rotatably supported only by the support 20 and not by the pin 30, which instead serves only to connect it to the lever 32 for setting in rotation.

Consequently, owing to these functional features it is possible to assemble apart, that is to say, offline, the support 20 with the cam 25 and the rocker arm 35, so as to be able then to fix them onto the lower leg envelopment in a single operation, for example simply by means of the screw 21 as suggested above, and the use of rivets or other fixing systems should not be excluded.

At the site of production, therefore, the lower leg envelopment already provided with the locking device can then be mounted on the shell in a manner which is known per se, after which it will be sufficient to install the pin 30 and the lever 32 to complete the device.

This latter operation is also easy to perform, because the cam through which the pin 30 must be inserted is already in the required position, since the support 20 on which it has been previously mounted is in turn fixed to the lower leg envelopment in a predetermined position: the correct alignment between the bore 27 and the holes present in the flanks 41*a*, 41*b* (not given a number in the drawings and intended to support the head 31 of the pin 30 and the cylindrical base 33 of the lever 32) of the recess 40 in which the pin 30 fits, is then obtained automatically.

This fact represents a significant advantage with respect to what generally occurs in the state of the art, where the assembly of the locking device is carried out together with that of the boot, requiring the hinging onto the lower leg envelopment, and/or onto the shell, of one or more elements of the articulated system in addition to their connection to the control lever.

In the present invention, however, this does not occur, because neither the cam 24 nor the rocker arm 35 is permanently hinged either to the lower leg envelopment or to the shell; as regards the cam, this is quite clear, while in relation to the rocker arm 35 it is sufficient to recall that its edge 36 only bears on the seating 14 of the shell. In this context, it should also be observed that the appendages 37*a*, 37*b* of the rocker arm 35, being able to slide along the slots 23*a*, 23*b* of the support 20, make it possible to compensate for any inaccuracies of assembly of the locking device on the lower leg envelopment or of the latter on the shell, so that the edge 36 of the rocker arm 35 always bears correctly in the seating 14.

A further important advantage provided by the invention lies in the fact that the structural simplification of the locking device compared with those which are known allows it to be manufactured also in plastics material, that is to say, a low cost material without particular mechanical properties; for example, it can be ascertained that the cam mechanism reduces the number of articulated connecting rods or cranks (see in this connection EP 0 248 149 and EP 0 085 026 already cited) and has intrinsic properties of robustness and reliability, derived also from the fact that its parts are predominantly stressed in compression.

On the other hand, the elements which constitute the various articulated systems employed in the locking devices marketed at present are customarily produced from metallic materials in order to ensure capacities of mechanical strength which are adequate for more serious stresses. For obvious reasons, the metals employed must also not deteriorate in contact with water and snow: therefore it is necessary to have recourse to components of stainless steel or other materials of similar capacity which are therefore relatively expensive.

Finally, it should be pointed out that in the device of the invention, the rotations of the control lever 32 occur in conformity with those of the lower leg envelopment with respect to the axis X—X; consequently, since the pin 30 is rigidly connected to both the lower leg envelopment and the cam, the displacements of the latter are transmitted by way of the aforesaid pin directly to the lower leg envelopment: this makes it possible, when the boot is to be brought into the skiing attitude, not to have to rotate the lower leg envelopment into the forward position first and then lock it by acting on the control lever, but rather to carry out both of these operations at the same time and with one hand only, with obvious advantages for the skier.

Finally, the fact should also be pointed out that in the device of the invention the position of the control lever 32 displaced laterally with respect to the median plane of the boot (that is to say, a plane perpendicular to the sole and which divides it into two substantially equal parts) facilitates its manipulation by a person having the skis on.

Account should be taken of the fact that skiers frequently loosen their boots at the end of a descent before ascending again with a ski-lift, drags or other similar lift equipment, still keeping the skis on; it can therefore be understood that in such a situation the handle of the lever positioned centrally with respect to the boot, as occurs in the known locking devices, is rendered more problematical by the presence of the bindings on the ski.

The off-centre position with reference to the aforesaid median plane instead renders the lever of the device of this invention more easily accessible to a person, thus proving more advantageous from this point of view.

From the particular placing of the lever mentioned above there also results as a further advantage the fact that the relative locking device can be housed inside the lower leg envelopment without being exposed to the external environment, and thus remaining protected from the snow. As can in fact be realised by observing the analogous devices described in the European Patent Applications already mentioned, the position of the control lever behind the relative articulated system necessarily involves the presence of a larger or smaller aperture, depending on the case in question, in the lower leg envelopment and/or in the shell through which the lever is connected to the remainder of the mechanism.

As a consequence, such an aperture allows the passage of snow which, if there is too much of it, may render the functioning of the device problematical; if then the aperture in question communicates with the inside of the boot, as it appears in the case of EP 0 248 149, it is clear that any possible penetration of snow would certainly not be pleasant for a skier.

Instead, in the present invention the positioning of the lever at the side of the mechanism constituted in the present case by the support 20 with the cam 24 and the rocker arm 35 requires, in order to be able to connect it to the latter, only small holes in the flanks 41*a,* 41*b* of the recess 40 which support the pin 30, according to what has been stated above (do not be misled by the fact that in FIG. 1 the locking device can be seen, since this has been done only for greater understanding of the invention by cutting away part of the lower leg envelopment of the boot).

The result of this is therefore that the possibility of penetration into the inside of the boot is eliminated, since the pin itself occupying the aforesaid holes in practice constitutes a seal preventing this.

The fact should not then be excluded that a similar arrangement of the lever may be usable also with locking devices different from that being considered here; this is in fact compatible in most cases, with all those locking devices in which the relative articulated mechanism is controlled by a lever which acts along an axis perpendicular to the plane in which the mechanism itself moves.

Figure 7:
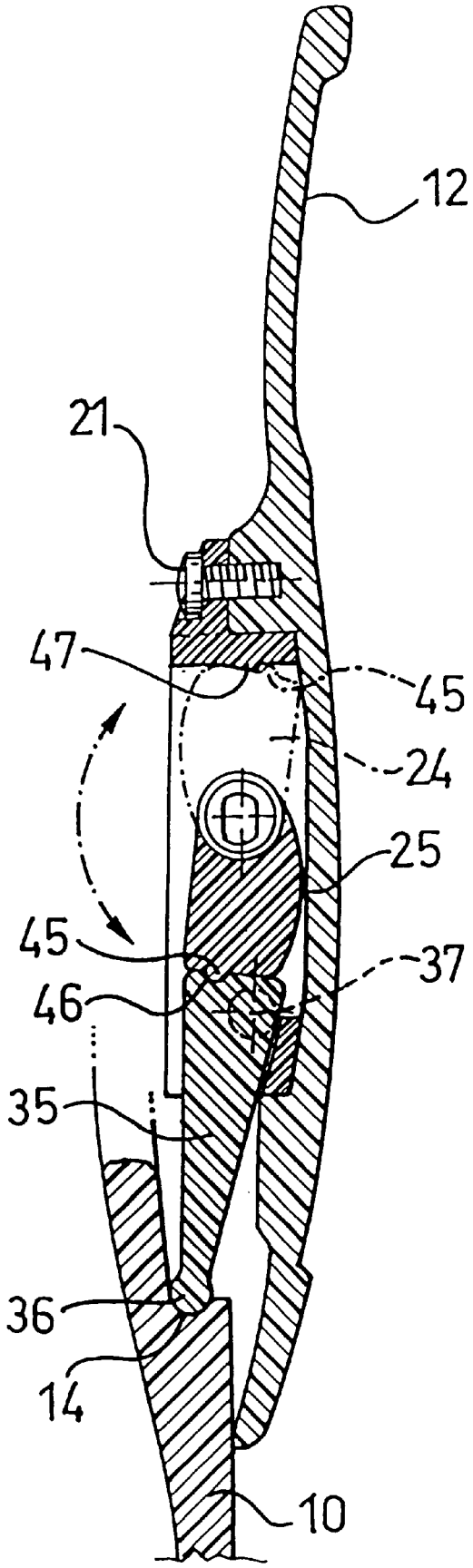
FIG. 7 shows in detail a variant of the device in the preceding figures.

Naturally, there should not be excluded further variants of the invention with respect to what has been disclosed hitherto; one of these variants is illustrated in FIG. 7, which provides an enlarged view of the mechanism forming part of this invention, and wherein the elements which have already been taken into consideration retain the same reference numbers.

In practice, said variant consists in the presence of a rib 45 raised with respect to the flat section 26 of the profile of the cam 25; this rib, which extends transversely to the cam, is intended to engage either with a hollow 46 of complementary shape provided in the flat surface 38 of the rocker arm 35 or with a tooth 47 projecting from the upper inner wall of the support 20.

In this way, further security and stability are imparted to the maintaining of the cam in the positions assumed by it for skiing and walking, locking it by means of the engagement of its rib with the aforesaid hollow and tooth.

These variants are however included in the teaching provided by the invention, as can be inferred from this description and from the claims which follow.

We claim:

1. In an article of sports footwear provided with a shell (10) on which a lower leg envelopment (12) is hinged along an axis (X—X) transverse to the footwear, and about which the lower leg envelopment rotates between a forward position and a set-back position, the improvement comprising a locking device mechanism (20, 24, 35) controlled by a lever (32), characterized in that the said mechanism includes:

a walled support (20) fixed to the lower leg envelopment, a cam (24) including a traverse bore (27) mounted rotatably on the said support about an axis substantially parallel to the axis of rotation of the lower leg envelopment, and a rocker arm (35) having a flat surface (38) complementary to an active profile of the cam, slidingly coupled to the support at one end by appendages (37*a,* 37*b*) engaged in slots (23*a,* 23*b*) and pivoting with respect to a bearing point (14) on the shell of the footwear, at the opposite end, and In that the control lever is capable of setting the aforesaid cam in rotation, wherein the cam (24) and the lever (32) are connected to the same pin (30) supported rotatably in the lower lea envelopment (12) alone the axis of rotation of the cam so as to rotate in unison.

2. Device according to claim 1, wherein the lever (32) is arranged at the side of the cam (24) along its axis of rotation, in an off-centre position with respect to a median longitudinal plane of the footwear.

3. Device according to claim 1, wherein the cam (24) is supported rotatably with respect to the support (20) by two appendages (28*a,* 28*b*) located on opposite sides of the cam and which engage In corresponding holes (22*a,* 22*b*) present in the support, and wherein between the said appendages there extends a bore (27) passing from one side to the other inside the cam for engagement by the pin (30).

4. Device according to claim 3, wherein the through bore (27) In the cam (24) and the pin (30) engaged therein have a complementary shape so as to form a linear prismatic pair capable of transmitting the torque applied to the lever.

5. Device according to claim 1, wherein the cam (24) has a profile which comprises a curved section (25) and a flat section (26) and wherein the flat section, when the lower leg envelopment (12) is rotated into the forward position, is in contact with a flat surface (38) of the rocker arm (35) so as to prevent the free rotatory reverse movement of the cam and to lock the lower leg envelopment in the said forward position.

6. Device according to claim 1, wherein the support (20), the cam (24) and the rocker arm (35) are produced from plastics material.

7. Device according to claim 5, wherein the cam (24) is provided on the flat section (26) of its profile with a rib (45), and wherein the rocker arm (35) and the support (20) have, respectively on the flat surface (38) and on the upper Inner wall, a hollow (46) and a tooth (47) which are intended to engage with the aforesaid rib.

8. A mechanism for a locking device, said mechanism comprising a walled support (20), a cam (24) including a traverse bore (27) mounted rotatably on the said support about an axis substantially transverse to the latter, and a rocker arm (35) having a flat surface (38) complementary to an active profile of the cam, slidingly coupled to the support along two slots (23*a,* 23*b*) arranged on opposed sides (20*a,* 20*b*) of the latter and orientated so as to be substantially perpendicular to the axis of rotation of the cam.

9. Mechanism according to claim 8, wherein the cam (24) has a profile with a curved section (25) and a flat section (26).

10. Mechanism according to claim 9, wherein the cam (24) is provided on the flat section (26) of its profile with a rib (45), and wherein the rocker arm (35) and the support (20) have, respectively on the flat surface (38) and on the upper inner wall, a hollow (46) and a tooth (47) which are intended for engagement with the aforesaid rib.

11. In an article of footwear according to claim 1, the improvement wherein the footwear is a ski boot.

12. In an article of sports footwear provided with a shell (10) on which a lower leg envelopment (12) is hinged along an axis (X—X) transverse to the footwear, and about which the lower leg envelopment rotates between a forward position and a set-back position, the improvement comprising a locking device mechanism (20, 24, 35) controlled by a lever (32), characterized in that the said mechanism includes:

a walled support (20) fixed to the lower leg envelopment, a cam (24) including a traverse bore (27) mounted rotatably on the said support about an axis substantially parallel to the axis of rotation of the lower leg envelopment, and a rocker arm (35) having a flat surface (38) complementary to an active profile of the cam, slidingly coupled to the support at one end by appendages (37*a,* 37*b*) engaged in slots (23*a,* 23*b*) and pivoting with respect to a bearing point (14) on the shell of the footwear, at the opposite end, and in that the control lever is capable of setting the aforesaid cam in rotation, wherein the cam (24) has a profile which comprises a curved section (25) and a flat section (26) and wherein the flat section, when the lower leg envelopment (12) is rotated into the forward position, is in contact with a flat surface (38) of the rocker arm (35) so as to prevent the free rotatory reverse movement of the cam and to lock the lower leg envelopment in the said forward position.

13. Device according to claim 5, wherein the cam (24) is provided on the flat section (26) of its profile with a rib (45), and wherein the rocker arm (35) and the support (20) have, respectively on the flat surface (38) and on the upper inner wall, a hollow (46) and a tooth (47) which are intended to engage with the aforesaid rib.

* * * * *